US011725857B1

(12) United States Patent
O'Brien et al.

(10) Patent No.: US 11,725,857 B1
(45) Date of Patent: Aug. 15, 2023

(54) HEAT PUMP

(71) Applicants: James O'Brien, Rockville, MD (US); Stanislaus Anthony Horvat, Rockville, MD (US)

(72) Inventors: James O'Brien, Rockville, MD (US); Stanislaus Anthony Horvat, Rockville, MD (US)

( * ) Notice: Subject to any disclaimer, the term of this patent is extended or adjusted under 35 U.S.C. 154(b) by 0 days.

(21) Appl. No.: 17/588,346

(22) Filed: Jan. 31, 2022

(51) Int. Cl.
*F25B 39/02* (2006.01)
*F25B 13/00* (2006.01)

(52) U.S. Cl.
CPC ..... *F25B 39/02* (2013.01); *F25B 13/00* (2013.01)

(58) Field of Classification Search
CPC ..... F25B 39/02; F25B 13/00; F25B 43/00; F25B 2313/008; F25B 2339/02; F25B 2500/28; F25B 5/02; F25B 41/20; F25B 41/42; F25B 41/45; F25B 2600/2507; F25B 2600/2511; F25B 2700/2106
See application file for complete search history.

(56) References Cited

U.S. PATENT DOCUMENTS

2018/0363947 A1* 12/2018 Cosby, II ..... C09K 5/045
2022/0003467 A1* 1/2022 Sakabe ..... F25B 49/02
2022/0057126 A1* 2/2022 Porwal ..... F25D 21/08
2022/0154057 A1* 5/2022 Allgood ..... F25B 45/00
2022/0325930 A1* 10/2022 Day ..... B60H 1/00907

* cited by examiner

*Primary Examiner* — Henry T Crenshaw
*Assistant Examiner* — Kamran Tavakoldavani
(74) *Attorney, Agent, or Firm* — Barry Choobin; Patent 360

(57) ABSTRACT

A system for a heat pump that allows the heat pump to work efficiently in extreme cold weathers. The system includes an evaporator influid communication with an expansion valve, the expansion valve can receive a liquid refrigerant from a condenser of the heat pump. The evaporator contains a pool of liquid refrigerant and an electric resistance heating source dipped in the pool of liquid refrigerant. The electric resistance heating source can heat the liquid refrigerant of the pool to generate vapors and thus maintaining a desired pressure within the heat pump.

8 Claims, 1 Drawing Sheet

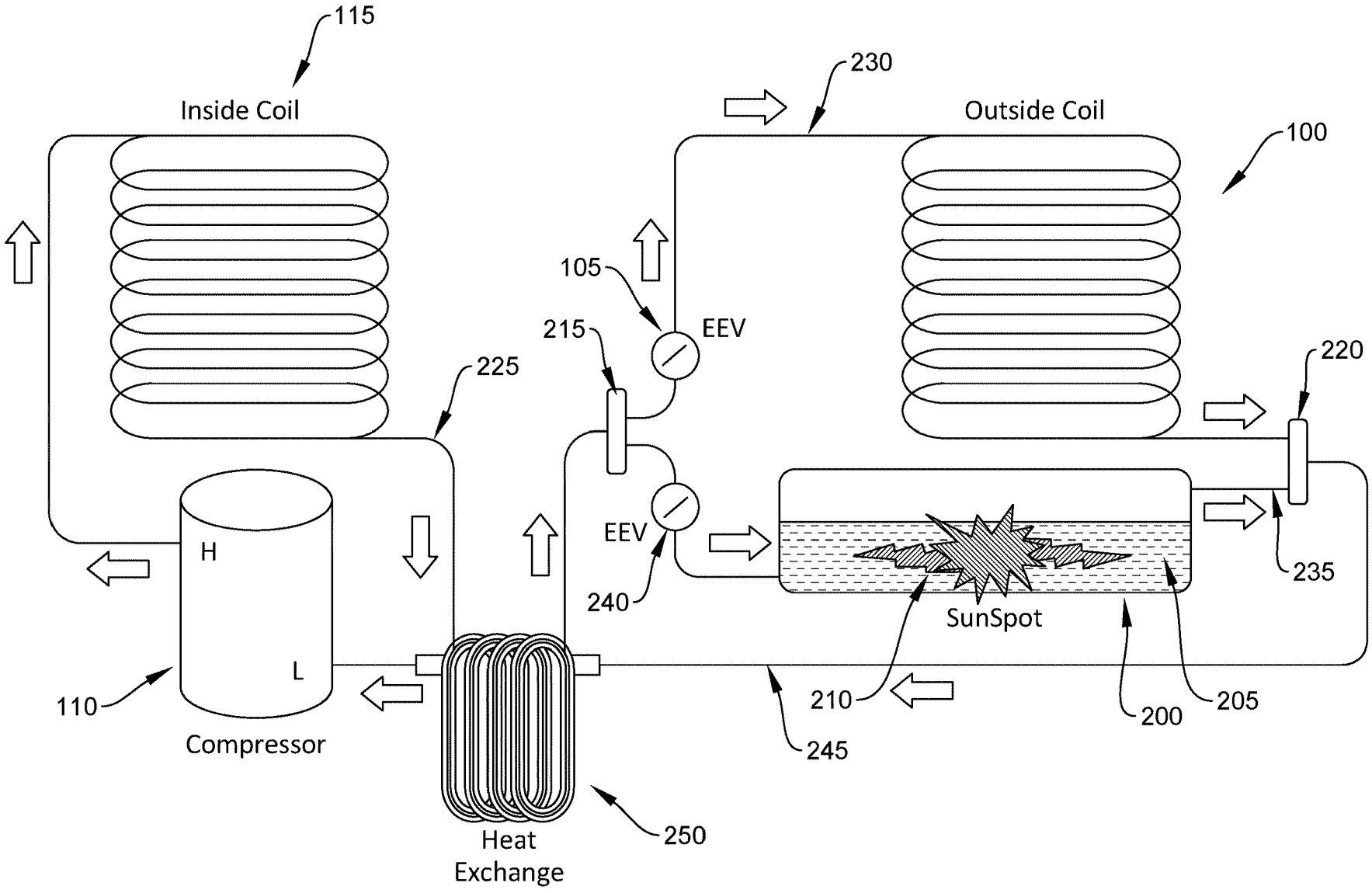
100
Outside Coil
230
220
235
205
200
SunSpot
210
245
EEV
105
215
EEV
240
250
Heat
Exchange
225
115
Inside Coil
H
L
Compressor
110

HEAT PUMP

FIELD OF INVENTION

The present invention relates to a field of electronic evaporators, heat pumps, and heat exchangers, and more particularly, the present invention relates to an electronic evaporator system for heat pumps that has two-stage suction line heat exchange.

BACKGROUND

Temperature conditioning for environmental control in working and living spaces have become quite common. The interior space of enclosed premises, whether a household or a commercial place, is generally cooled or warmed. In cold climates, it is always desired to keep the interiors warm in comparison to the outside temperatures. A variety of heat sources to supply heat to the interiors of the premises are available and used around the world. A few examples of conventional heat sources include gas burners, wood burners, fireplaces, oil burners, and the like. However, electric-powered residential heat pumps are becoming a prevalent source of heat as the world is transitioning from fossil fuels to electricity-based systems.

The heat pumps offer several advantages, such as using natural heat and being energy efficient, however, the heat pumps lose much of their efficiency in extremely cold temperatures and must be supplemented by expensive electric resistance heaters that are built into the building's ductwork.

Thus, a need is appreciated for a system that allows the use of heat pumps outside the present operating temperature range, thus eliminating the need of supplementing the electric resistance heaters or conventional fuel-based heat sources.

SUMMARY OF THE INVENTION

The following presents a simplified summary of one or more embodiments of the present invention in order to provide a basic understanding of such embodiments. This summary is not an extensive overview of all contemplated embodiments and is intended to neither identify key or critical elements of all embodiments nor delineate the scope of any or all embodiments. Its sole purpose is to present some concepts of one or more embodiments in a simplified form as a prelude to the more detailed description that is presented later.

The principal object of the present invention is therefore directed to a system for heat pumps that allow the heat pumps to operate both in cold and extreme cold climate conditions.

It is another object of the present invention that renewable energy sources can be used.

It is still another object of the present invention that the system is energy efficient.

It is yet another object of the present invention that the system can retrofit to an existing heat pump.

BRIEF DESCRIPTION OF THE DRAWINGS

The accompanying figures, which are incorporated herein, form part of the specification and illustrate embodiments of the present invention. Together with the description, the figures further explain the principles of the present invention and to enable a person skilled in the relevant arts to make and use the invention.

FIG. 1 is a schematic diagram showing the system installed in a heat pump, according to an exemplary embodiment of the present invention.

DETAILED DESCRIPTION

Subject matter will now be described more fully hereinafter with reference to the accompanying drawings, which form a part hereof, and which show, by way of illustration, specific exemplary embodiments. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, a reasonably broad scope for claimed or covered subject matter is intended. Among other things, for example, the subject matter may be embodied as methods, devices, components, or systems. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage or mode of operation.

The terminology used herein is for the purpose of describing particular embodiments only and is not intended to be limiting of embodiments of the invention. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely for the purpose of illustrating the general principles of the invention, since the scope of the invention will be best defined by the allowed claims of any resulting patent.

Disclosed is a system for heat pumps that allows the heat pumps to work in a wide temperature range in which the convention heat pumps otherwise fail. The disclosed system can retrofit in a heat pump and allows the heat pump to operate at the outside temperatures below 40° F., below 17° F., and below 5° F. Also are disclosed heat pumps incorporating the disclosed system that can operate at the outside temperatures below 40° F., below 17° F., and below 5° F. A convention heat pump includes a liquid refrigerant, compressor, condenser, expansion valve, and an outside coil for the exchange of heat between an external heat source and the refrigerant.

Referring to FIG. 1, which is a schematic diagram showing the disclosed system. The disclosed system can be used with a convention heat pump. FIG. 1 shows an outside coil 100, a first expansion valve 105, a compressor 110, and a condenser 115, all are well known for use in convention heat pumps. The disclosed system includes an evaporator 200, the evaporator contains a pool of liquid refrigerant 205, and an electric resistance heating source 210. The electric resistance heating source 210 can remain dipped in the pool of liquid refrigerant 205 within the evaporator 200 for heating the liquid refrigerant. Additionally, it is also envisioned to use renewable sources of energy including solar energy, wind energy, and geothermal energy. The disclosed system can further include a first diverter 215 and a second diverter 220. The first diverter 215 can channel a single stream of refrigerant into two streams of refrigerant. The second diverter 220 can combine the two streams of the refrigerant into a single stream of refrigerant. A return line 225 extends from the inside coil 115 to the first diverter 215. A first line 230 extends from the first diverter 215 to the second diverter 220. A second line 235 extends between the first diverter and the second diverter 220. The first line 230 can be interrupted by the first expansion valve 105 and the outside coil 100 in series. The second line 235 can be interrupted by a second expansion valve 240 and the disclosed evaporator 200 in series. An intake line 245 extends between the second diverter 220 and the compressor 110. The return line 225 and the intake line 245 can be interrupted by a residual heat exchanger 250. The residual heat exchanger 250 allows heat exchange between the return line 225 and the intake line 245. The disclosed residual heat exchanger 250 can be a double coil heat exchanger or a coaxial heat exchanger. While FIG. 1 illustrates a specific type of residual heat exchanger, it is understood, that any other type of heat exchanger known to a skilled person is within the scope of the present invention.

A control unit (not shown) can control the operation of the first diverter and the second diverter. The control unit can control the distribution of the refrigerant between the first line and the second line based on the predefined rules and the outside temperature. The second diverter can combine the evaporated refrigerant from the first line and the second line to an intake line.

When the outside temperature is within the operable temperature range of a convention heat pump, the disclosed system can remain offline. The refrigerant circulating through the outside coil can absorb heat. For example, the outside coil can be an air coil receiving heat from the outside environment, wherein the blower can circulate the outside air around the outside coil. The air can transfer heat to the refrigerant flowing with the outside coil. The structure and working of the outside coil are well known and hence not described further herein. The vapors can be carried to the residual heat exchanger through the intake line, wherein the vapors can absorb any residual heat from the refrigerant in the return line from the condenser. The vapors from the residual heat exchanger can then be fed to the compressor which further supplies heat to the vapors. The heat from the vapors can be used by an interior air conditioning system to warm the interiors. The heat from the vapors can be absorbed by the condenser resulting in liquifying of the refrigerant. The first diverter can channel the liquid refrigerant in the return line to the first line and nothing may flow to the second line. The liquid refrigerant in the first line can expand in the first expansion valve and recirculate in the outside coil.

When the outside temperature falls below the normal operating range of a conventional heat pump, a portion of the refrigerant from the return line can be channelized to the second line by the first diverter. The proportion of the liquid refrigerant channeled into the second line can be inversely proportional to the outside temperature. More is the drop in the outside temperature, more of the liquid refrigerant can be diverted to the second line. The control unit can be configured with predefined rules, wherein the control unit can receive the outside temperature and accordingly operate the first diverter to control the distribution of liquid refrigerant between the first line and the second line. The liquid refrigerant in the second line can expand in the second expansion valve. The vapors from the expansion valve can then be fed into the evaporator. The vaporized refrigerant can gain heat in the evaporator and feed to the intake line through the second diverter. The refrigerant from the outside coil (first line) and the disclosed evaporator (second line) can be combined by the second diverter. The combined stream through the intake line can be fed into the residual heat exchanger.

The disclosed evaporator can include a pool of liquid refrigerant and an electric resistance heat source to heat the liquid refrigerant. The disclosed evaporator can maintain the desired pressure of the vapors in the system by heating the liquid refrigerant to generate the vapors. The electric resistance heater can also be powered by renewable energy sources, such as but not limited to solar energy and wind energy. Besides the electric resistance heaters, a suitable heat exchanger can also be used wherein heat for an external source can be supplied to the pool of liquid refrigerant in the disclosed evaporator through the heat exchanger. The control unit can also control the operation of the electric resistance heater.

The disclosed system can allow the liquid refrigerant from the condenser to further lose heat and get cooled in the residual heat exchanger as described above. Additionally, the liquid refrigerant can further be cooled by releasing residual heat to the pool of liquid refrigerant in the disclosed evaporator. A second residual heat exchanger (not shown) can be provided in the pool of liquid refrigerant, wherein the second line, before the second expansion valve, can be interrupted by the second residual heat exchanger. The liquid refrigerant in the return line received from the residual heat exchanger can be fed to the second residual heat exchanger to further lose the heat and get cooled before feeding into the second expansion valve.

The disclosed system and method can deliver the required amount of BTUs to the heat pump as it significantly reduces the heat pump's overall amperage consumption. A heat pump equipped with the disclosed system no longer needs an auxiliary heating unit during cold weather operations, nor does it need to expend valuable energy to defrost the outdoor evaporator—because the outdoor evaporator is shut off during cold weather operations. The evaporator can be a flooded evaporator with electric resistance heating coils in the bottom of the pool of liquid refrigerant. In cold weather, when the temperatures drop below 30° F., a portion of the liquid refrigerant leaving the condenser is diverted to the disclosed evaporator and the remainder travels to the outside coil. The two streams of refrigerant are regulated by two electric expansion valves, which in turn are regulated by outside air temperature via a sensor and a PLA controller (control unit). As the outside temperature further drops, more refrigerant can be diverted to the disclosed evaporator. In one case, the electric resistance heater can be configured with 3 levels of heat, high, medium, and low. The PLA controller can select the level of heat according to outside temperatures and indoor ambient temperature.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. A system for a heat pump, the system comprising:

an evaporator, the evaporator in fluid communication with a first expansion valve, the first expansion valve configured to receive liquid refrigerant from a condenser, the evaporator further comprises:

a pool of liquid refrigerant contained in the evaporator; and a heater dipped in the pool of liquid refrigerant and configured to evaporate liquid refrigerant in the pool of liquid refrigerant; and a first diverter in fluid communication with a return line, a first line, and a second line, the return line is in fluid communication with the condenser and carries the liquid refrigerant from the condenser, the first line connects to the first expansion valve, and the second line connects to a second expansion valve, wherein the first diverter is configured to distribute the liquid refrigerant between the first line and the second line.

2. The system according to claim 1, wherein the system further comprises:

a control unit, the control unit operably coupled to the heater.

3. The system according to claim 2, wherein the first diverter operably coupled to the control unit, wherein the control unit is configured to control the distribution of the liquid refrigerant between the first line and the second line based on at least an outside temperature.

4. The system according to claim 1, wherein the system further comprises:

a second diverter in fluid communication with the first line, the second line, and an intake line, the second diverter configured to combine streams of refrigerant in the first line and the second line, and feed the combined stream of refrigerant to the intake line, wherein the intake line connects the second diverter to a compressor.

5. The system according to claim 4, wherein the return line and the intake line are interrupted by a first residual heat exchanger configured to permit exchange of heat between the return line and the intake line.

6. The system according to claim 4, wherein the second line between the second expansion valve and the second diverter is interrupted by an outside coil.

7. A heat pump comprising:

a compressor;

a condenser;

an outside coil;

a system, the system comprising:

an evaporator, the evaporator in fluid communication with a first expansion valve, the first expansion valve configured to receive a liquid refrigerant from the condenser, the evaporator further comprises:

a pool of liquid refrigerant contained in the evaporator; and a heater dipped in the pool of liquid refrigerant and configured to evaporate liquid refrigerant in the pool of liquid refrigerant; and a first diverter in fluid communication with a return line, a first line, and a second line, the return line is in fluid communication with the condenser and carries the liquid refrigerant from the condenser, the first line connects to the first expansion valve, and the second line connects to a second expansion valve, wherein the first diverter is configured to distribute the liquid refrigerant between the first line and the second line.

8. A method for operating a heat pump comprising a compressor; a condenser; and an outside coil, the method comprises the steps of:

providing a system for the heat pump, the system comprising:

an evaporator, the evaporator in fluid communication with a first expansion valve, the first expansion valve configured to receive a liquid refrigerant from the condenser, the evaporator further comprises:

a pool of liquid refrigerant contained in the evaporator; and a heater dipped in the pool of liquid refrigerant and configured to evaporate liquid refrigerant in the pool of liquid refrigerant; and a first diverter in fluid communication with a return line, a first line, and a second line, the return line is in fluid communication with the condenser and carries the liquid refrigerant from the condenser, the first line connects to the first expansion valve, and the second line connects to a second expansion valve, wherein the first diverter is configured to distribute the liquid refrigerant between the first line and the second line.

* * * * *